US006677688B2

(12) United States Patent
Freeston et al.

(10) Patent No.: US 6,677,688 B2
(45) Date of Patent: Jan. 13, 2004

(54) SCALABLE N×M, RF SWITCHING MATRIX ARCHITECTURE

(75) Inventors: Andrew Freeston, Amerst, NH (US); Paul Schwab, Hudson, NH (US)

(73) Assignee: Tyco Electronics Corporation, Middletown, PA (US)

( * ) Notice: Subject to any disclaimer, the term of this patent is extended or adjusted under 35 U.S.C. 154(b) by 397 days.

(21) Appl. No.: 09/859,264

(22) Filed: May 17, 2001

(65) Prior Publication Data

US 2002/0063475 A1 May 30, 2002

Related U.S. Application Data

(60) Provisional application No. 60/210,139, filed on Jun. 7, 2000.

(51) Int. Cl.[7] ..... H01H 19/64

(52) U.S. Cl. ..... 307/113; 307/116; 307/140; 333/101; 333/103; 333/104; 340/14.63

(58) Field of Search ..... 307/113, 116, 307/140; 333/101, 103, 104; 340/14.63

(56) References Cited

U.S. PATENT DOCUMENTS

| | | | | |
|---|---|---|---|---|
| 3,374,364 A | | 3/1968 | Concelman | 307/257 |
| 3,816,830 A | | 6/1974 | Giannini | 343/100 |
| 3,996,533 A | | 12/1976 | Lee | 333/7 R |
| 4,129,838 A | | 12/1978 | Wallington et al. | 333/7 D |
| 4,165,497 A | * | 8/1979 | Irons | 333/101 |
| 4,399,439 A | | 8/1983 | Upadhyayula | 340/825.91 |
| 4,495,498 A | * | 1/1985 | Petrelis et al. | 340/825.79 |
| 5,170,139 A | | 12/1992 | Nelson | 333/103 |
| 5,510,757 A | | 4/1996 | Kumar et al. | 333/104 |
| 5,666,089 A | | 9/1997 | Ehlers | 333/81 R |
| 6,265,953 B1 | * | 7/2001 | Romano | 333/101 |

FOREIGN PATENT DOCUMENTS

| | | | |
|---|---|---|---|
| EP | 0474337 A1 | 11/1992 | H03H/11/24 |

OTHER PUBLICATIONS

Patent Abstract of Japan; publication No. 10093302; publication date Oct. 4, 1998; inventor: Kawaoka Yoshizumi, Title: Signal Changeover Switch.

Patent Abstract of Japan; publication No. 08032395; publication date; Feb. 2, 1996; inventor Uchiyama Fumihiko; Title: Variable Attenuator.

* cited by examiner

*Primary Examiner*—Brian Sircus
*Assistant Examiner*—Robert L DeBaradinis

(57) ABSTRACT

A scalable N×M switching matrix architecture is characterized by a readily calculable number of crossover locations and comprises one or more single pole, N throw ("SPNT") switches and, for each such switch, an N state impedance converter/amplitude compensation network.

8 Claims, 4 Drawing Sheets

SCALABLE N×M, RF SWITCHING MATRIX ARCHITECTURE

This application claims the benefit of provisional application No. 60/210,139 filed Jun. 7, 2000.

FIELD OF THE INVENTION

The present invention relates generally to RF circuit switching architectures and, more particularly, to non-blocking, N×M switching matrices.

BACKGROUND OF THE INVENTION

A conventional approach to realizing a non-blocking N×M switching matrix in RF frequency applications is shown in FIG. 1. As seen in FIG. 1, each of power dividers $D_1$, $D_2$, $D_3$, and $D_4$ are configured to receive a corresponding RF signal input at input ports designated $RF_{in}$1, $RF_{in}$2, $RF_{in}$N-1, and $RF_{in}$N, respectively. At each power divider, the RF input signal is directed to output paths 1-M. These paths are then switched in and out using 1×N switches, indicated generally at $S_1$, $S_2$, $S_3$, and $S_N$, disposed at the outputs, indicated generally at $RF_{out}$1, $RF_{out}$2, $RF_{out}$N-1, and $RF_{out}$N.

A principal disadvantage of the arrangement shown in FIG. 1 is that the power dividers are frequency limited. Additionally, routing every RF input signal over plural paths to reach the corresponding switch simultaneously establishes multiple leakage paths for each input. This opportunity for isolation degradation is, consequently, multiplied by the number of splits on each input. Moreover, as a consequence of this multiple stage architecture, the input paths must be routed in a fashion which creates numerous cross over points, only some of these being identified by reference numeral CO in FIG. 1. The inability to provide adequate isolation between the input signal lines has made the above-described approach wholly impractical and unsuited to implementation as a discrete IC. While it might be possible to construct a multiple layer printed circuit board (PCB) with shielded ground planes between layers to minimize cross talk and achieve acceptable isolation between signal paths, given the complexity of routing the paths in such a device, it is presently not possible to simulate or predict what level of isolation will be achieved until such a device were actually constructed and tested. In any event, it is believed that adapting the above-described matrix architecture to the ever-increasing numbers of inputs and outputs demanded by modem applications would pose substantial reliability concerns.

SUMMARY OF THE INVENTION

The aforementioned deficiencies are addressed, and an advance is made in the art, by a switching architecture having the advantages of broad bandwidth, high isolation, and an ability to be implemented at the IC level due to a systematic approach taken to ensure isolation.

The scalable N×M switching matrix architecture of the present invention is characterized by a readily calculable number of cross over locations so that leakage can be accurately modeled and predicted. A scalable N×M switching matrix architecture is characterized by a readily calculable number of crossover locations and comprises one or more single pole, N throw ("SPNT") switches and, for each such switch, an N state impedance converter/amplitude compensation network. In accordance with the present invention, each SPNT switch network selects the output to any of the N inputs in any combination with up to all N inputs being selected on. Collectively, the individual 1×N networks formed by each combination of SPNT switch and its corresponding impedance converter/amplitude compensation network comprises the N×M network.

In all switch conditions, the impedance and insertion loss of each SPNT switch is maintained by an impedance converter/amplitude compensation network. The number of output ports determines the number (M) of 1×N networks in the matrix. The number of input ports is set by the number of legs (N) in the SPNT switch. By placing the SPNT switch as the last element before the output, the number of cross over points is maintained at a number which can be readily calculated based on the number of inputs and outputs.

BRIEF DESCRIPTION OF THE DRAWINGS

Illustrative embodiments of the invention will now be described, by way of example, with reference being made to the accompanying drawings wherein like numerals refer to like parts and further wherein.

DETAILED DESCRIPTION OF THE INVENTION

Figure 1:
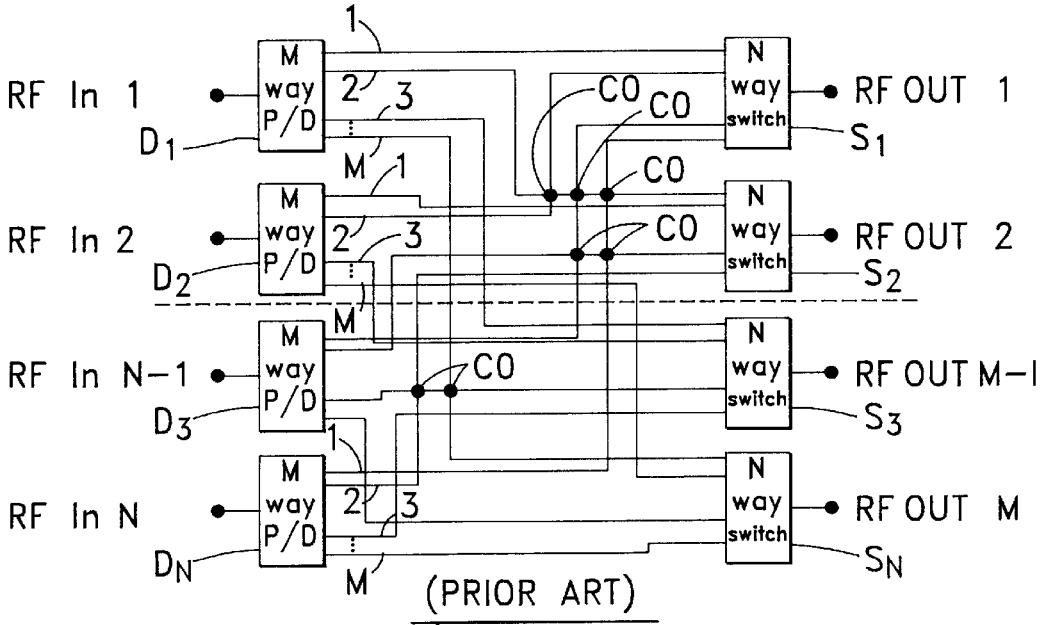
(PRIOR ART) Fig. 1
FIG. 1 is a block diagram depicting a conventional non-blocking N×M switching matrix suitable for only a relatively small number of RF signal inputs and not adaptable for implementation as an integrated circuit.
Figure 2:
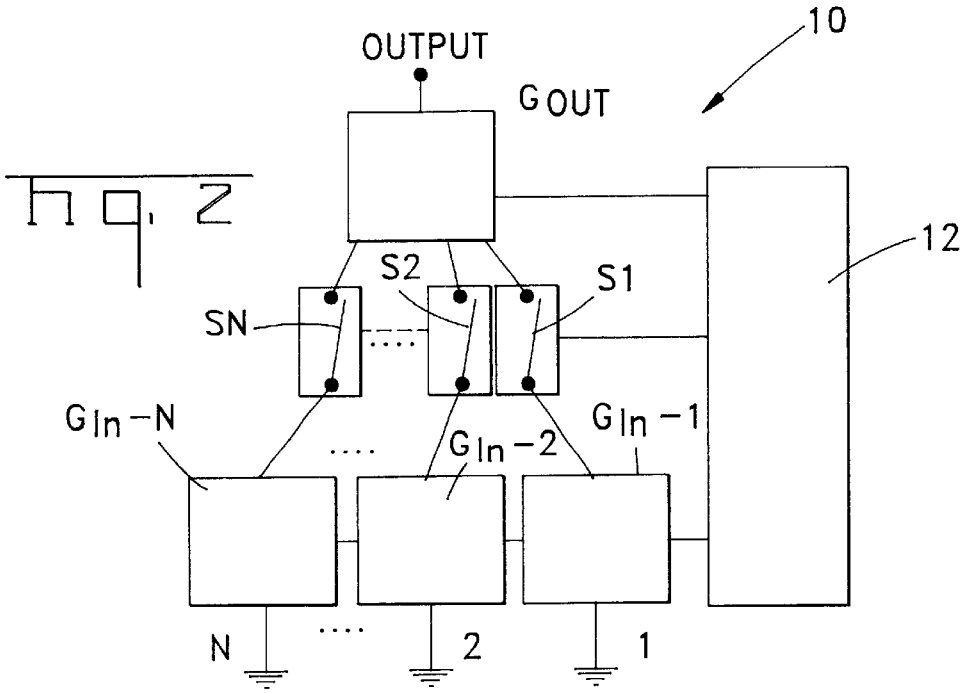
FIG. 2 is a block diagram schematic of a novel individual 1×N switch network element constructed in accordance with an aspect of the present invention.
Figure 3A:
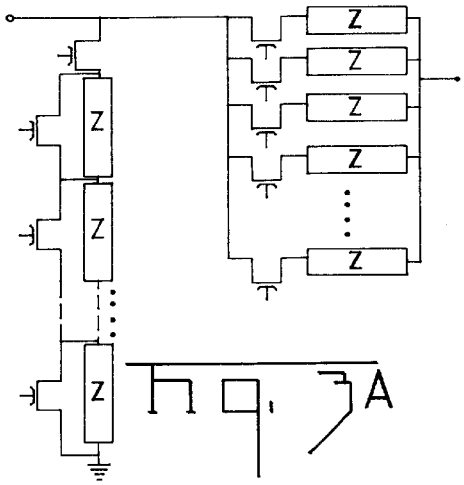
FIGS. 3A–3D are circuit schematics depicting various topologies for obtaining impedance and gain compensation in accordance with another aspect of the present invention.
Figure 3B:
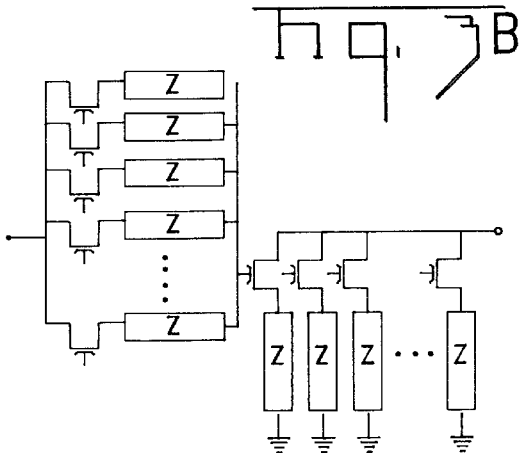
Figure 3C:
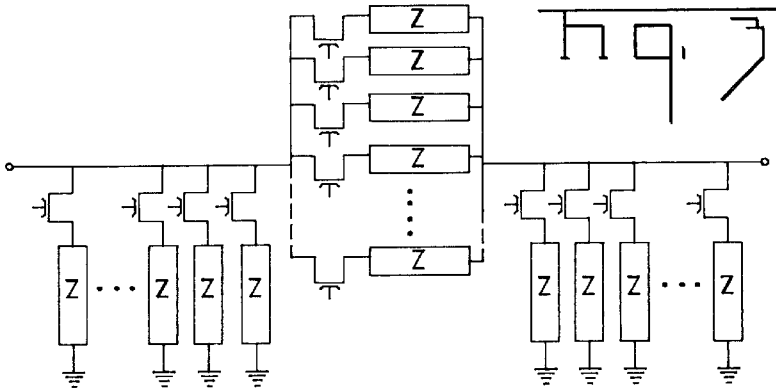
Figure 3D:
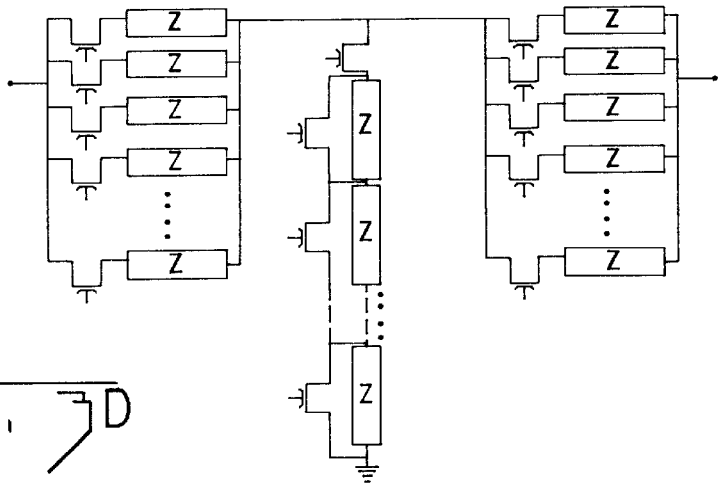

With initial reference to FIG. 2, there is shown a 1×N switch network 10, for use in an N×M switching matrix architecture according to the present invention, which provides not only 1×N switching connectivity, but also impedance and gain compensation regardless of the number of ports selected to be output. Each switch, $S_1$ through $S_N$, is directly controlled by embedded control logic 12 located on the same integrated circuit chip (IC) as the other components of the network 10. Impedance and/or gain compensation, which may as in the illustrative embodiment depicted in FIGS. 2–3D, be variable to permit multiple ports to be selected to a single output simultaneously, is performed by discrete impedance and gain compensation circuit modules indicated generally at $G_{in}$1 through $G_{in}$N and $G_{out}$.

Initially, it should be noted that conventional 1×N switches have several limitations which make them unsuitable for the non-blocking architecture contemplated by the inventors herein. First, such devices require many control lines, leading to complex routing requirements and user interface. Second, if multiple ports are switched to the same port simultaneously, the impedance seen at the ports gets lower and lower, proportional to the number of ports selected. Not only does the port impedance vary dramatically, the insertion gain varies significantly as well. Needless to say, it is undesirable to have such variations. Current switch matrix solutions also require multiple die and driver integrated circuits within a complex and costly package. As well, they are limited in their ability to maintain constant insertion and return loss through different switch states. Heretofore, switches have been designed to operate in a single system impedance environment, requiring multiple versions of the switch and external components to operate with proper impedance in systems of variable impedance.

The present invention, on the other hand, utilizes switched impedance circuitry to maintain constant, wide band port impedance and insertion gain. External driver circuitry is not needed because all of the logic is preferably incorporated on a single IC. Advantageously, the IC uses different combinations of internal impedance blocks to maintain constant match and gain. Several illustrative topologies, in which the impedance blocks are arranged to achieve the flexibility and functionality required to implement a non-blocking N×M switch architecture in accordance with the present invention, are shown in FIGS. 3A–3D.

Preferably, each of these topologies uses a parallel path method for creating the attenuation steps. That is, instead of "daisy chaining" multiple attenuators, each with a bypass transistor for use when that stage is not desired, a "PI", "T" or other equivalent structure as shown in FIGS. 3A–3D is made with parallel resistive elements. This results in superior return loss and lower reference insertion loss as compared to conventional multi-step attenuator design approaches. Note that an ideal multistep attenuator would have no reference insertion loss. For example, a 5 dB multistep attenuator would be expected to have steps between 0 and 5 dB attenuation. In reality, there is loss in each bypass stage, so the conventional approach using bypass transistors would typically have been characterized by a reference insertion loss of 1.5 dB. The parallel method is therefore especially preferred for use in conjunction with implementing 1×N switch networks in accordance with the present invention since the reference loss is significantly reduced in comparison to the conventional bypass transistor approach.

As will be readily appreciated by those skilled in the art, the effect of switching multiple impedance in parallel or in series gives a varies overall input and output impedance, as well as varied insertion gain. The individual impedance are chosen so that appropriate lumped impedance are acquired for each desired state. These can be any combination of resistance, capacitance, and inductance to get the requisite values. By varying these impedance and gains, it is possible to offset the variation that would otherwise exist in a switch without this impedance/gain control. With such offsets, the device can maintain a constant input and output impedance and overall port to port gain.

In any event, and with continued reference to FIGS. 3A–3D, it will be appreciated that the illustrative topologies may be used individually or in any combination as required for the specific system impedance of a particular application. That is, the precise topology used will be based upon the particular impedance and loss requirements of each application. For each port or combination of ports selected by SPNT switch SW under the direction of embedded logic control 12 (FIG. 2), a specific combination of impedance is used. Accordingly, the invention permits operation with more than one system impedance without degradation of performance. An external control word may be used to specify the system impedance so that the embedded control logic 12 (FIG. 2) can implement multiple sets of impedance combinations. As such, a single component as network 10 may be used to function in a wide variety of impedance networks.

Preferably, a serial control interface is used to reduce the number of needed control lines. The device can be implemented in an addressable configuration, so that multiple serial devices can be on the same serial bus yet maintain individual device control, greatly simplifying the higher level assembly of the IC.

Figure 4A:
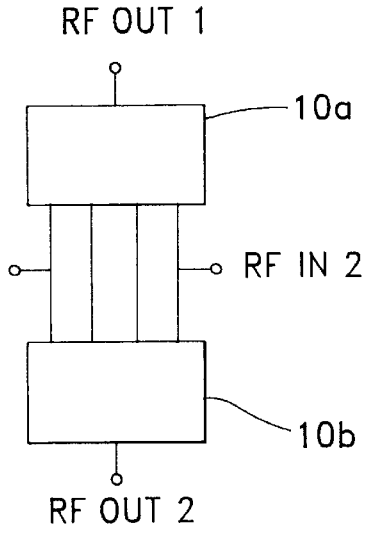
FIGS. 4A–4C are block diagrams respectively depicting illustrative configurations of non-blocking 2×2, 4×4, and 4×6 switch matrix architectures constructed in accordance with the present invention.
Figure 4B:
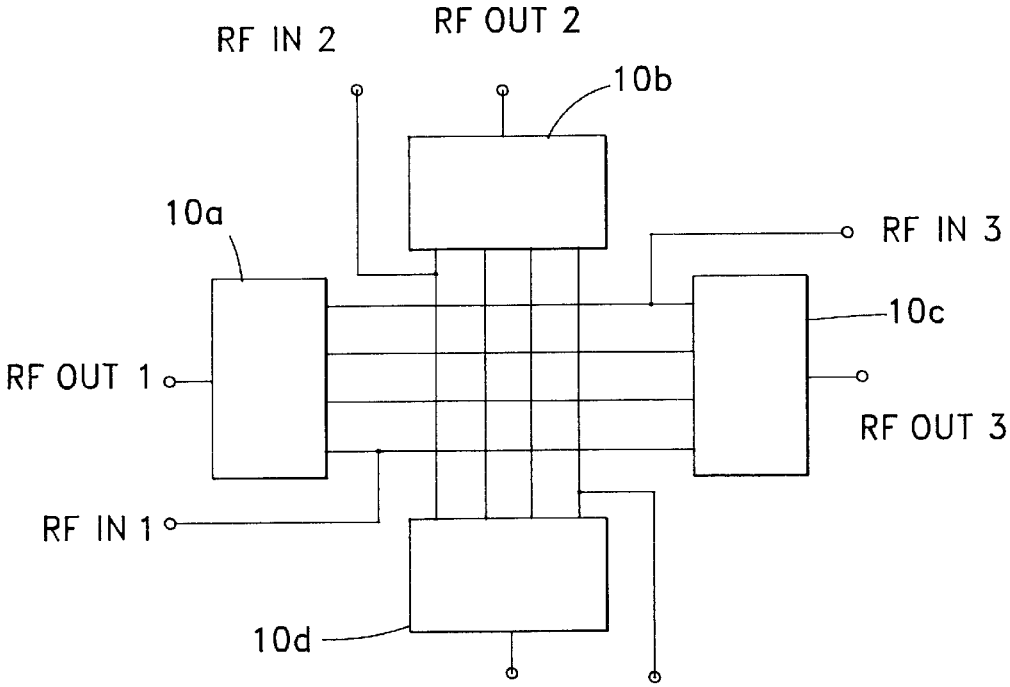
Figure 4C:
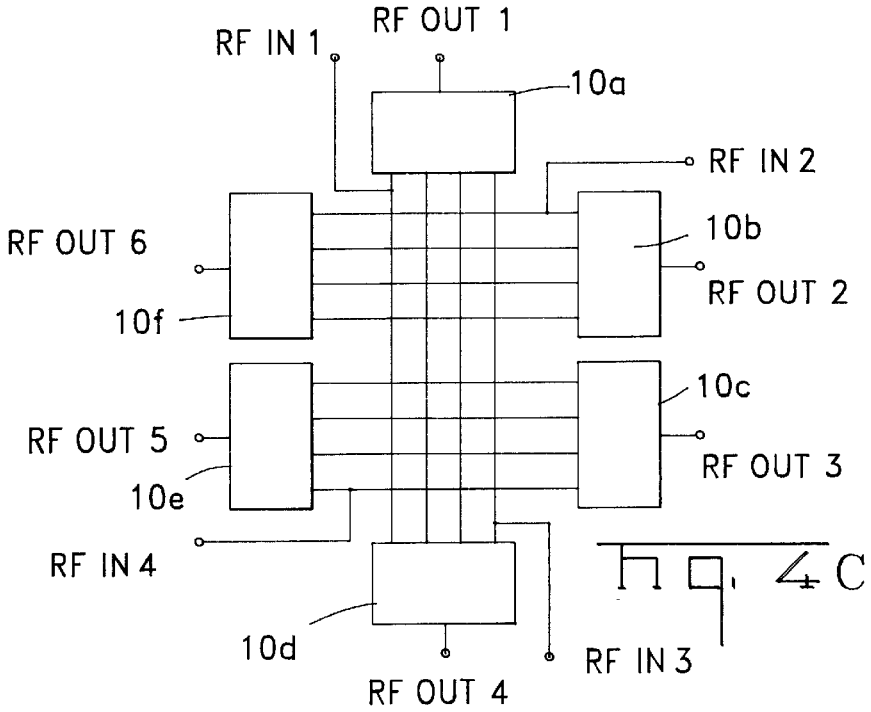

In any event, and with particular reference now to FIGS. 4A–4C, several non-blocking configurations employing the above-described 1×N switching network element 10 will now be described. In FIG. 4A, for example, there is shown a 2×2 non-blocking switch matrix architecture comprising two 1×N switching networks indicated generally at 10*a* and 10*b*. In FIG. 4B, a 4×4 non-blocking switch matrix architecture is depicted, the structure using four 1×N switching networks indicated generally at 10*a*, 10*b*, 10*c* and 10*d*. In FIG. 4C, there is shown yet another example of a non-blocking switch matrix architecture constructed in accordance with the present invention, this time employing six 1×N switching networks indicated generally at 10*a*, 10*b*, 10*c*, 10*d*, 10*e* and 10*f*.

Under the control of embedded control logic 12 (FIG. 2), the SPNT switch SW of each 1×N network as network 10*a* can select the output to any of the N inputs in any combination with up to all N inputs being selected on. In the preceding embodiments depicted in FIGS. 4A–4C, N would be 2, 4 and 4, respectively. In all switch conditions, the impedance and the insertion loss of the switch is maintained by the impedance converter/amplitude compensation network comprising gain modules $G_{in}$-1 through $G_{in}$-N and $G_{out}$ (FIG. 2).

Figure 5:
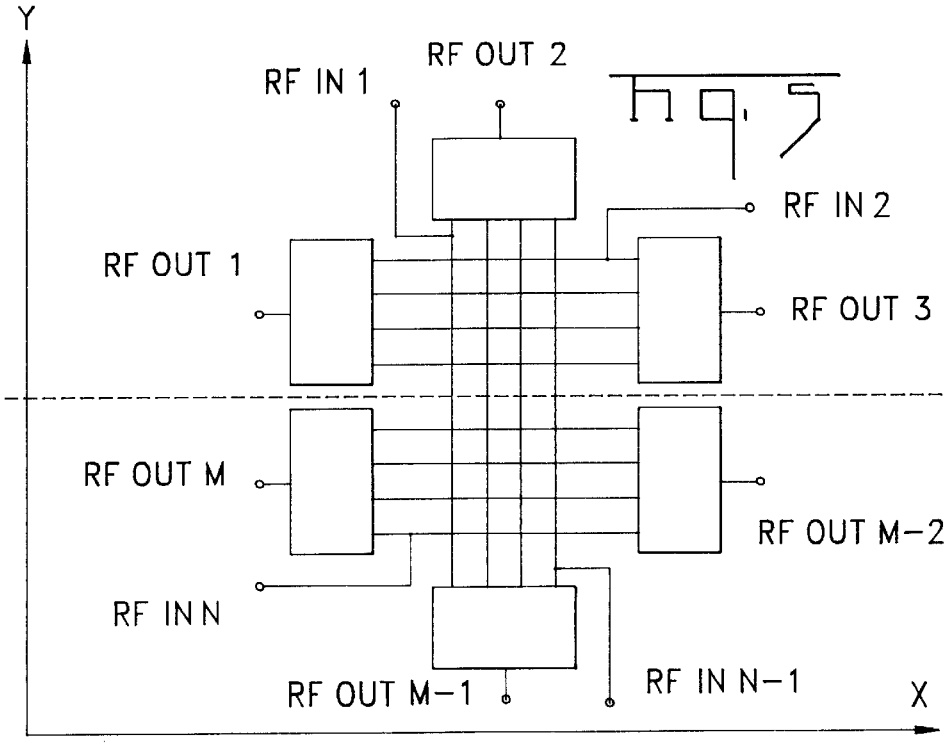
FIG. 5 depicts a non-blocking N×M switching matrix architecture constructed in accordance with the present invention and in which each switch element is aligned such that the inputs are directed towards each other and interconnected in a grid fashion.

A generalized case, i.e., an N×M architecture is depicted in FIG. 5 with each switch element 10*a*–10*f* being aligned such that the inputs are directed towards each other and interconnected in a grid fashion. The RF portion of each switch element is identical, but the input port selected for any given control word can be controlled by a control logic block. Hence, the layout of the matrix is optimized such that the number of crossovers is minimized to maximize the overall isolation performance of the matrix.

For a symmetrical switch matrix in which the number of inputs is equal to the number of outputs (i.e., N=M, N≠2), the minimum number of crossovers (CX) in the matrix is given by the relation:

$$CX=N^{2-}-N$$

For a matrix which is not symmetrical, the number of crossovers depends on the configuration but can be easily calculated. By placing the 1×N switches across the X and Y directions as shown in FIG. 5, the calculation of the number of crossovers is:

$$CX=(N*SE_x)*((N-1)*SE_y)$$

where $SE_x$ is the number of switch elements in the X direction and $SE_y$ is the number of switch elements in the Y direction (see FIG. 5). For example, a 4×6 switch matrix configured as shown in FIG. 4C would be:

$$CX=(4*1)*((4-1)*2)=24$$

Just as important as the total number of crossovers is the number of crossovers associated with each switch leg. Preferably, the number of crossovers is kept constant for each input. By designing the architecture such that each associated input has the same number of crossovers, it is possible to ensure that each input is equally loaded. Advantageously, the predictability of the RF matrix of the present invention enables it to be accurately simulated using a variety of ubiquitous commercial RF CAD tools so that the operating performance can be readily simulated and characterized.

What is claimed is:

1. A scalable, non-blocking N×M switching matrix architecture having a number of crossovers (CX) in the matrix represented by the following equation:

$$CX=(N*SE_x)*((N-1)*SE_y)$$

wherein

N is the number of inputs in the matrix;

M is the number of outputs in the matrix;

$SE_x$ is the number of switch elements in the X direction; and $SE_y$ is the number of switch elements in the Y direction; with the proviso that when N=M (N≠2), $CX=N^2-N$; wherein each said switch element in the matrix comprises a single pull, N- throw switch.

2. The switching matrix architecture of claim 1, wherein the architecture comprises at least one mingle pole, N throw switch and, for each such switch, an N state impedance converter/amplitude compensation network.

3. The switching matrix architecture of claim 2, wherein the N state impedance converter/amplitude compensation network comprises impedance and gain compensation circuit modules.

4. The switching matrix architecture of claim 3, wherein the modules are arranged in a topology that utilizes a parallel path method for creating attenuation steps.

5. The switching matrix architecture of claim 3, wherein the modules are selected and arranged to maintain constant input and output impedance and overall port-to-port gain.

6. The switching matrix architecture of claim 2, wherein each switch network selects the output to any of the N inputs in any combination with up to all N inputs being selected an.

7. The switching matrix architecture of claim 2, wherein each switch is directly controlled by embedded control logic.

8. The switching matrix architecture of claim 1, wherein the number of crossovers for each input is kept constant.

* * * * *